US007234615B2

(12) United States Patent
Presser et al.

(10) Patent No.: US 7,234,615 B2
(45) **Date of Patent: *Jun. 26, 2007**

(54) LOW FRICTION HANGER SYSTEM AND HANGERS FOR USE THEREWITH

(76) Inventors: Mark A. Presser, 9600 Cattaraugus Ave., Los Angeles, CA (US) 90034; Harry Zimmerman, 310 Comstock Ave., Los Angeles, CA (US) 90024; David Harilela, 29-43 Ashley Road, Room 201-205 Kowloon Centre, Tsim Sha Tsui, Kowloon (HK)

( * ) Notice: Subject to any disclaimer, the term of this patent is extended or adjusted under 35 U.S.C. 154(b) by 0 days.

This patent is subject to a terminal disclaimer.

(21) Appl. No.: 11/124,311

(22) Filed: May 6, 2005

(65) Prior Publication Data

US 2005/0242134 A1 Nov. 3, 2005

Related U.S. Application Data

(63) Continuation-in-part of application No. 10/828,635, filed on Apr. 20, 2004.

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS

| | | | | |
|---|---|---|---|---|
| 3,448,902 | A * | 6/1969 | Stebbins | 223/85 |
| 3,486,683 | A * | 12/1969 | Kamins et al. | 383/23 |
| 3,935,976 | A * | 2/1976 | Mizrach | 223/88 |
| 5,167,564 | A * | 12/1992 | Lord | 446/479 |
| 2004/0069819 | A1 * | 4/2004 | Strouts | 223/85 |
| 2005/0173475 | A1 * | 8/2005 | Murphy, Jr. | 223/85 |

* cited by examiner

*Primary Examiner*—Shaun R. Hurley
(74) *Attorney, Agent, or Firm*—Christie, Parker & Hale, LLP.

(57) ABSTRACT

A low friction hanger system for reducing the lateral force required to move a hanger having a hook and a wider, lower balance beam portion on a rod. The system includes a friction reducing element located between a hanger hook of the hanger and a supporting rod. The friction reducing element can include a roller or low friction material either integral with the hanger hook or retrofitted thereto. The friction reducing element can also include low friction material on the rod which is either integral therewith or retrofitted thereto. Optionally, lateral force displacement magnets or laterally extending arms will aid in the lateral displacement the hanger relative to other hangers.

12 Claims, 6 Drawing Sheets

LOW FRICTION HANGER SYSTEM AND HANGERS FOR USE THEREWITH

CROSS-REFERENCE TO RELATED APPLICATIONS

This application is a continuation-in-part and claims the benefit of U.S. patent application Ser. No. 10/828,635, filed on Apr. 20, 2004.

FIELD OF THE INVENTION

The present invention relates to improvements in the current system and methods that are in place for hanging clothes or other items that utilize a two or more piece system that incorporates at least a hanger and a supporting type rod or equivalents. The invention allows for easier movement of the hanged material and allows for more even distribution of the hanged material.

BACKGROUND OF THE INVENTION

When one looks at magazines or television programs that highlight closets, one might notice that the clothes are typically shown hanging very neatly and separated and evenly spaced to give a tidy and organized appearance. In reality, very few people have closets where the clothes naturally hang the way they are depicted in the magazines. If one were to look at most people's closets, one would notice that more than likely the clothes are clumped together with the hanger tops close and angled in a way that gives a disorderly appearance. In addition, when the user attempts to move clothes that are hanging in the closet in an effort to remove a particular article, sometimes a great amount of force and balance is required, particularly if many articles of clothing are to be shifted. This can be difficult, particularly for the elderly and the handicapped, and can make it very difficult to remove clothes, especially if the closet is full of hung items.

Besides using hangers to hang garments, there are other applications for hangers and rods, such as using hangers to hang other items, including hanging storage bags for prescription medications in pharmacies, folders for papers, just to name a few.

An important objective of a commercial outlet, such as a clothing store or boutique, is to make browsing through the products as easy as possible. While the invention is clearly not limited to garment hangers and a system, herein the example clothing on garment hangers will be used. With current hanger systems, many garments will hang on the same rack, which can require many hung garments to be moved when seeking to view and/or remove a specific garment. Also, in the case of circular clothing racks, a large number of units of hung clothes may need to be shifted. It stands to reason that if garments can be moved on a hanger with less effort, this will be advantageous since it will help a customer to view potential purchases more easily, making that customer less likely to walk away without first looking through everything they came to see. Many stores have employees who, as a part of their responsibilities, have to constantly move garments in an effort to cater to their customers. If the moving of multiple garments can be made easier and require less effort, this may lessen the possibility of repetitive physical stress to the employees which can in turn increase employee productivity and job satisfaction.

There accordingly remains a need for a system for making it easier for people to keep hanged items more evenly spaced apart from each other and easier to move on hangers on the rack.

BRIEF DESCRIPTION OF THE INVENTION

The invention utilizes a friction lessening means or material located on at least one of the hook portion of the hanger and the rod where the hook portion of the hanger and the rod make contact in order to reduce friction and decrease the amount of force needed to move the hanger on the rod.

In addition, the invention preferably allows the hangers to evenly distribute themselves either through the natural attributes of physical science and through mechanical design (e.g., springs) or by magnetic repulsion, by implanting magnets with similar polarity embedded in the body of the hanging system.

In addition, the invention preferably has a lower body area that is wider than the upper hook area. It is expected that the current invention will have to accommodate many different materials, shapes, sizes and weights, and that in the normal course of use the user will remove and replace the hanger onto the rod. Having a larger lower body area acts in a similar manner to a balance beams used by high wire artists, adding stability and insuring that the center of gravity remains close to the center of gravity of the friction reducing mechanism.

In practice, a user will hang his or her clothes on a hanger of the invention and then place the hanger on the bar or rod. In the case where the friction lessening feature is on the hanger neck, the portion of the hanger neck with the friction lessening feature will make contact with the bar and will ride on the bar. The friction lessening feature can comprise a roller element, including a ball bearing or plurality of ball or roller bearings structures. As used herein, the term "roller element" is defined to mean any mechanical friction reducing mechanism, which can include but is not limited to wheels, ball bearings and rollers. The friction lessening feature can also include a low friction piece of material such as Teflon®, carbon, carbon polymer or other materials located on an underside of the hanger neck where it contacts the bar or rod. Alternately, the low friction feature can be located on an upper portion of the bar or rod, and, for example, can comprise low friction material such as Teflon®. As used in this application, the term "friction reducing material" or "low friction piece of material" is defined as an insert which lowers the frictional coefficient that would otherwise be there had the material not been included. The friction lessening feature will help with the problem of multiple hangers on the same rod bunching up. Indeed, instead of bunching up together as a result of friction holding the hangers in place, as is the problem with prior art hangers and rods, the hangers of the invention will be able to move more naturally to a position of natural equilibrium as there is little opposing resistance from the contact point of hanger and rod with the significant reduction in friction.

In addition, it is foreseeable that under certain circumstances relatively heavy items, such as heavy coats, and other items put onto these hangers may result in a vertical load that might overcome part of the benefit afforded from the friction-reducing feature of the invention. To address these types of situations, a further feature of invention can include a means to provide an ancillary external lateral force that will aid the natural tendency for adjacent hangers to spread apart. This ancillary external lateral force means can be in the form of an embedded magnet or a mechanically designed arm that is integrated into the hanger and which act as a force feature that would work laterally in aiding in the spreading apart of adjacent hangers. In addition the invention preferably has a lower body area that is longer in length then the upper hook area. It is probable that the current invention will have to accommodate many different materials, shapes, sizes and weights, and that in the normal course of its use, the user will remove and replace the hanger onto the rod. Having a larger lower body area acts in a similar manner to a balance beam used by high wire artists, adding stability and insuring that the center of gravity remains close to the center of the fiction reducing mechanism.

The invention includes an embodiment where the friction-limiting device is a separate device, e.g., a sleeve with an integrated friction-diminishing device built into it that can be attached to retrofit any existing hanger. This separate device can be attached to the hook portion of any existing hanger as a retrofit. Moreover, the friction lessening feature can be built directly into a rod or can be provided as a retrofit device that can be attached to at least a top edge of the rod to provide for decreased friction.

The invention also includes a method for making hangers self-align on a rod, wherein a very low friction contact is established between a hanger and a hanger rod and wherein optional mechanical and/or magnetic repulsion means are used to aid in the self-alignment feature.

DETAILED DESCRIPTION OF THE INVENTION

Figure 1:
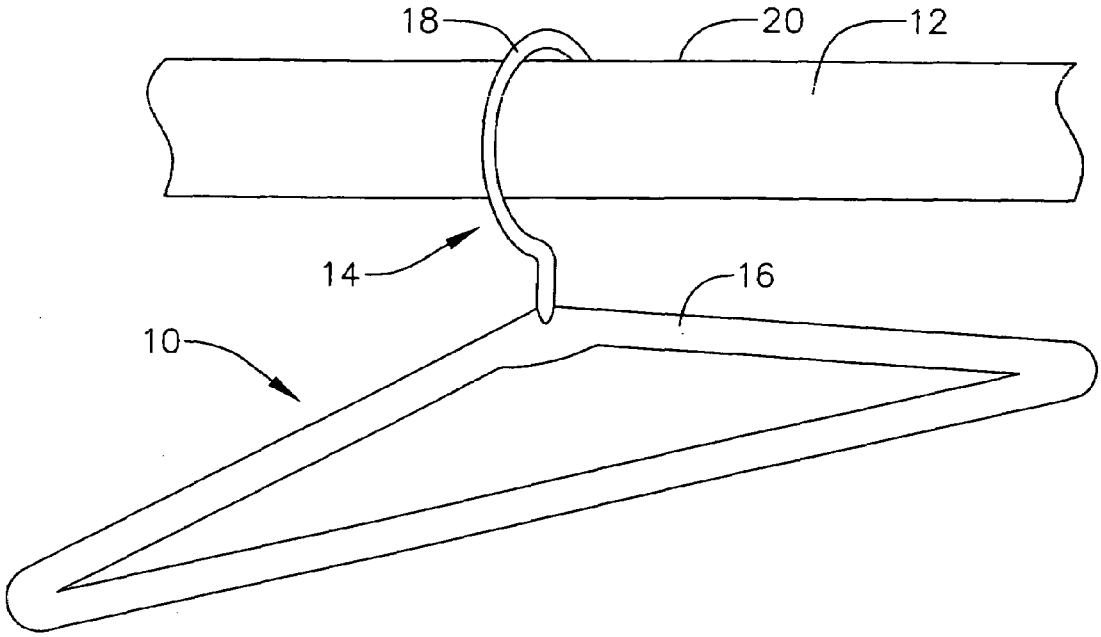
FIG. 1 PRIOR ART
FIG. 1 is a perspective view of a prior art hanger on a prior art clothes rod.

The invention is now described with reference to the drawings. FIG. 1 is a perspective view of an exemplary prior art clothes hanger 10 on a prior art clothes rod 12. The clothes hanger 10 has a hook portion 14 connected to a lower hanger portion 16. An underside of the upper hook portion 18 will make contact with an upper surface 20 of the rod. Prior art garment hangers can be formed of bent wire, metal, wood, plastic and/or papers and other materials. The hook portion can be integral with the lower portion and is typically formed of plastic, wood or metal. Clothes rods are typically made of wood, metal or plastic. There is often a considerable amount of friction between where the hook portion rests on the rod, and particularly when heavy items are carried on a garment hanger, a considerable amount of force may be needed to move clothes hung on a hanger on a rod.

Figure 2:
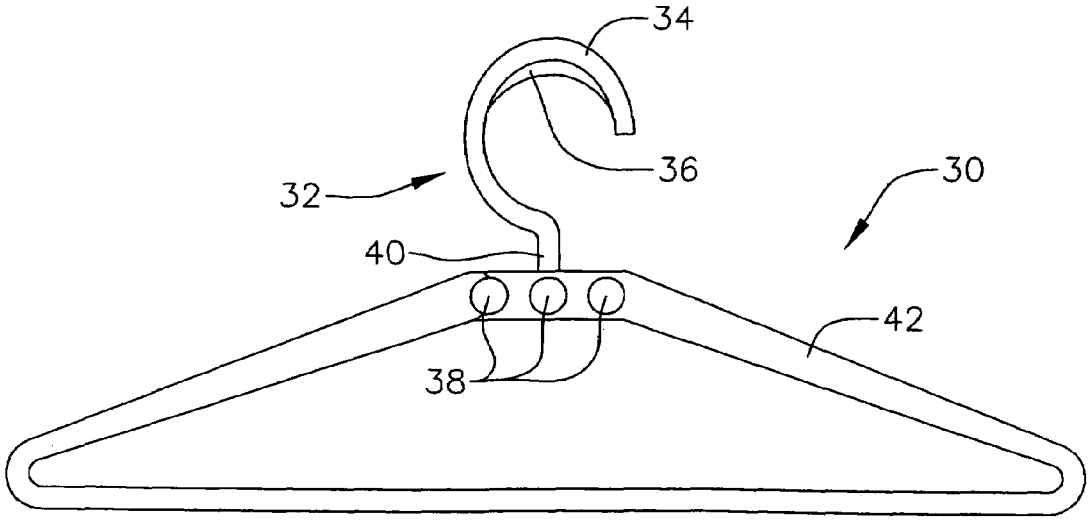
FIG. 2 is a plan view of one exemplary embodiment of a low friction hanger of the invention and shows a wider lower body and a narrower upper hook.

FIG. 2 is a plan view of an exemplary embodiment of a low friction hanger 30 of the invention. Low friction hanger 30 has a hook portion 32 with an upper hook portion 34 having low friction material 36 located on an underside thereof. This low friction material can comprise, for example and without limitation, a hard and slick plastic material such as Teflon®. Distance adjustment means 38 to provide for self adjustment of the distance between adjacent hangers can optionally be provided on the hanger, e.g., at a portion below where a neck 40 of hook portion joins an upper portion of a generally triangular shaped lower hanger portion 42. The distance adjustment means 38 can comprise, for example, permanent magnets which act in synergy with the friction reducing feature and are aligned such that the magnetic fields of adjacent hangers will repeal each other, and thus provide a motive force to assist in self-aligning hangers. (See FIG. 10). The lower hanger portion by design has a lateral width "B" that is wider than the corresponding width "N" of the upper neck 34 and thus serves to support items in a balance beam manner.

While FIG. 2 shows a fairly conventional generally triangular shaped lower hanger portion 42, other shapes and embodiments can be used, and as used herein the term hanger refers to hangers that have a neck portion that rides on a rod or rack that has a lower, wider body portion or body portions that can support any number of items, clothing and otherwise, such as belts, ties, slacks, coats and jackets, shirts to name just a few.

Figure 3A:
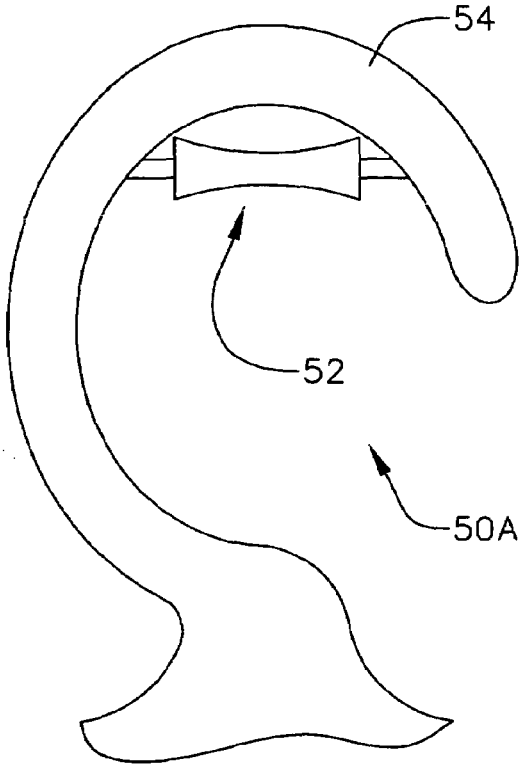
FIG. 3A is a detail showing the hook portion of an exemplary embodiment of a low friction feature of the hanger of the invention having a single roller.
Figure 3B:
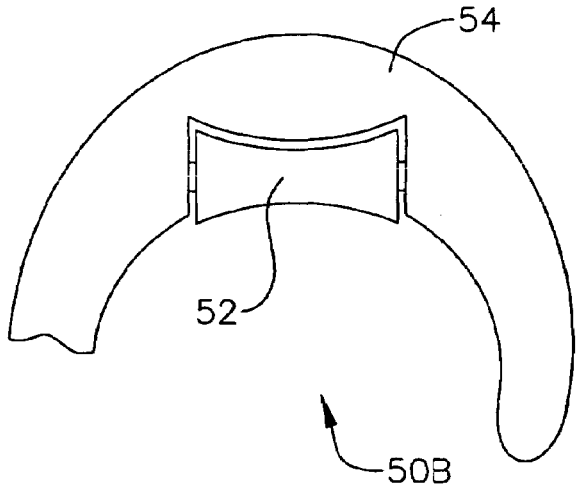
FIG. 3B is a detail showing the hook portion of an exemplary embodiment of a low friction feature of the hanger of the invention having a single roller that is more integrated into the bottom of the hook portion.

FIG. 3A is a detail showing the hook portion 50A of an exemplary embodiment of a low friction feature of the hanger of the invention comprising a roller element in the form of a single roller 52 below the upper hook portion 54. The roller 52 will preferably have a concave curvature that will accommodate a wide variety of different sized rods and will permit even hangers carrying heavy items to be easily moved on a rod with little lateral force required. The precise shape of the roller can be modified as necessary. Also, as is shown in FIG. 3B, roller 52 can be incorporated more fully into the upper curved portion 54 of the hook portion 50B for stylistic and sizing considerations. Again, as used herein, the term "roller element" is defined to mean any mechanical friction reducing mechanism, which can include but is not limited to wheels, ball bearings and rollers. single roller 52 below the upper hook portion 54. The roller 52 will preferably have a concave curvature that will accommodate a wide variety of different sized rods and will permit even hangers carrying heavy items to be easily moved on a rod with little lateral force required. The precise shape of the roller can be modified as necessary. Also, as is shown in FIG. 3B, roller 54 can be incorporated more fully into the upper curved portion 52 of the hook portion 50B for stylistic and sizing considerations. Again, as used herein, the term "roller element" is defined to mean any mechanical friction reducing mechanism, which can include but is not limited to wheels, ball bearings and rollers.

FIG. 3B is a detail showing the hook portion of an exemplary embodiment of a low friction feature of the hanger of the invention having a single roller that is more integrated into the bottom of the hook portion.

Figure 4:
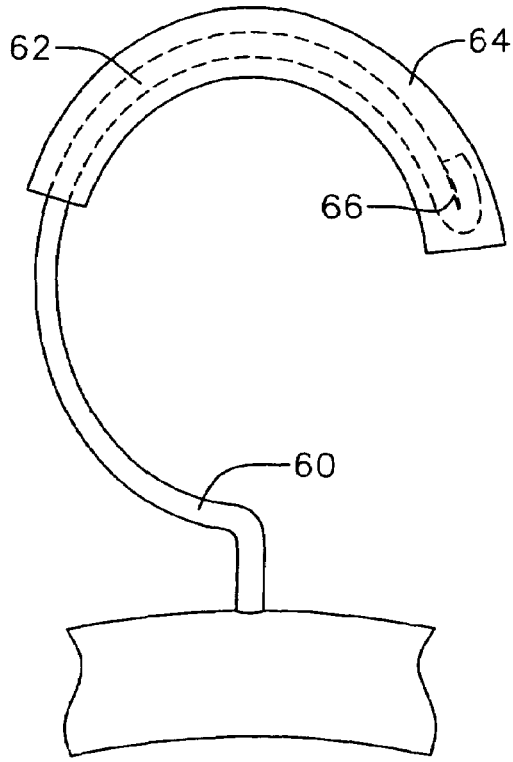
FIG. 4 is a partially exposed detail showing the hook portion of an exemplary embodiment of a low friction retrofitable cover for hanger hooks installed on a hanger hook.

FIG. 4 is a partially exposed detail showing the hook portion 60 of a hanger (not shown) which has its upper portion 62 covered with an exemplary embodiment of a low friction retrofitable cover 64 for hanger hooks. The retrofitable cover 64 can be preformed of low friction material, such as Teflon® and can be designed to slide over the free end 66 of hook portion, and thereby imbue a convention hanger with low friction attributes.

Figure 5A:
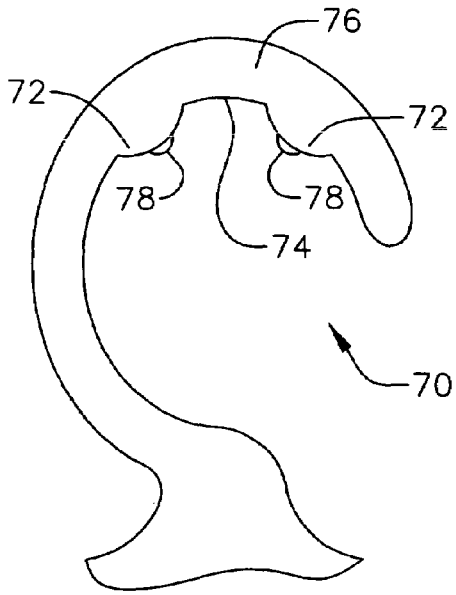
FIG. 5A is a detail showing the hook portion of a further exemplary embodiment of a low friction feature of the hanger of the invention having two rollers.

FIG. 5A is a detail showing the hook portion 70 of a further exemplary embodiment of a low friction feature of the hanger of the invention having two roller portions 72 incorporated into a lower side 74 of the upper portion 76. Each roller portion 72, can, for example have rolling bearing members, such as ball bearings 78 which will freely roll and establish low friction contact points with the rod (not shown).

Figure 5B:
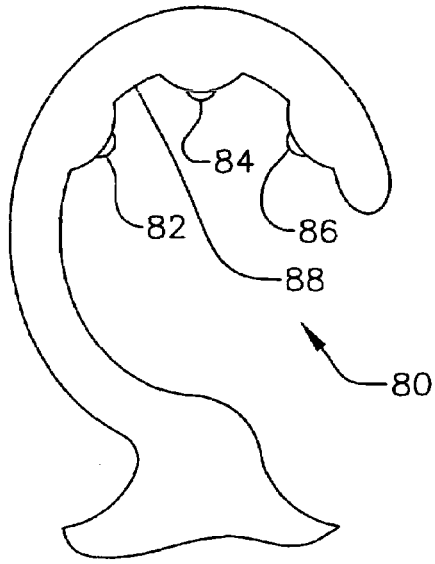
FIG. 5B is a detail showing the hook portion of a further exemplary embodiment of a low friction feature of the hanger of the invention having three rollers.

FIG. 5B is a detail showing the hook portion of a yet further exemplary embodiment of a low friction feature of the hanger hook 80 of the invention having three roller elements 82, 84 and 86 located on an underside 88 of hanger hook with roller 84 preferably arranged directly under a center of gravity CG of the hanger, and will be straddled by roller elements 82 and 86, which can be relatively widely spaced apart to accommodate hanger rods of a wide variety of dimensions.

Figure 6:
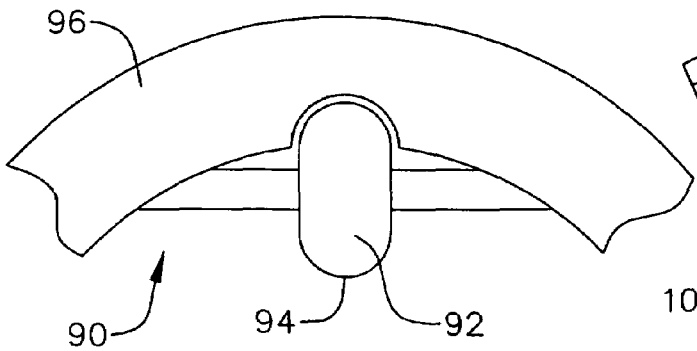
FIG. 6 is a detail showing another exemplary embodiment of a low friction feature of the hanger of the invention having a wheel.

FIG. 6 is a detail showing another exemplary embodiment of a low friction feature 90 of the hanger of the invention, which has a wheel roller 92 that has a smaller contact area 94 and smaller profile than the wider rollers 54 of the embodiments of FIGS. 3A and 3B. The wheel roller 94 is rotatably affixed to an upper hook portion 96.

Figure 7:
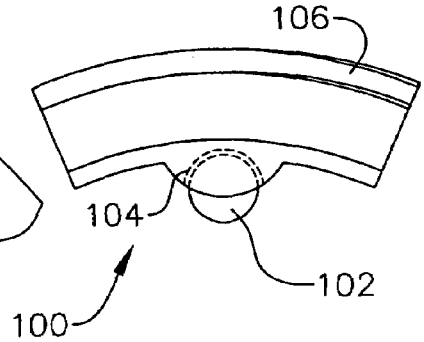
FIG. 7 is a detail showing an exemplary embodiment of a retrofitable low friction feature of the hanger of the invention for installing on a hanger hook.

FIG. 7 is a detail showing an exemplary embodiment of a retrofitable low friction hanger device 100 of the invention. The retrofitable feature comprises a roller bearing 102 rollably affixed to an affixation portion 104. Although depicted as a hollow curved tube section 106 for slipping over the upper portion of a hook portion of a hanger, it can be in the form of a clip structure which is adapted for affixation to the underside of a hanger hook if desired, or another structure. Furthermore, other types of rolling members can be provided.

Figure 8:
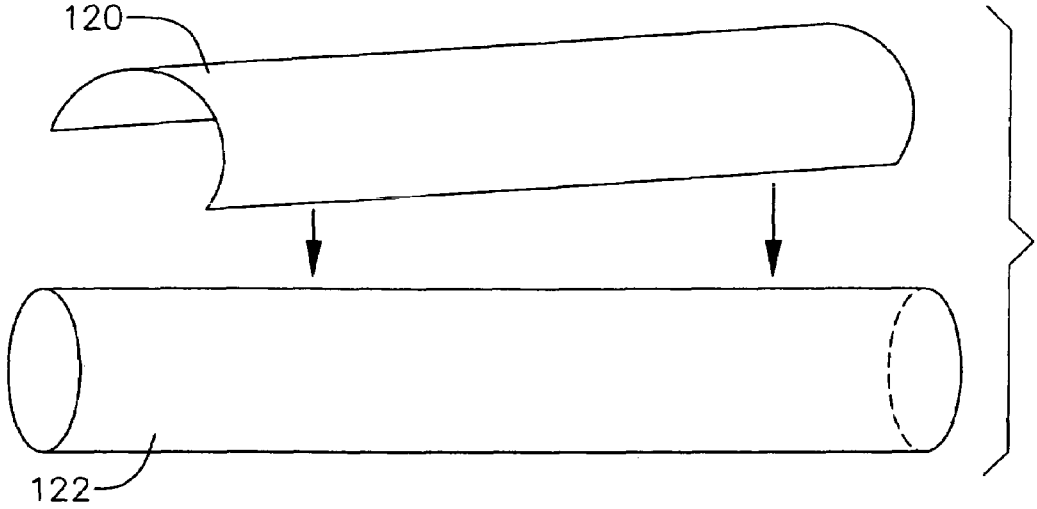
FIG. 8 is a perspective view showing an exemplary embodiment of a low friction cover being attached to a top portion of a hanger rod.

FIG. 8 is a perspective view showing an exemplary embodiment of a low friction cover 120, which is adapted to fit over at least a top portion of a hanger rod. In the embodiment shown, the low friction cover (e.g. made as hard or silica plastic or metal) has shape that comprises a portion of the outer shell of a cylinder, and can be adapted to snap around the rod 122 and/or can be affixed there with adhesives (e.g. peel and stick type, etc.) Other lower friction cover shapes can comprise, for example, a narrow strip, and can be formed of durable, yet low friction material, such as a hard and slick plastic such as Teflon®.

Figure 9:
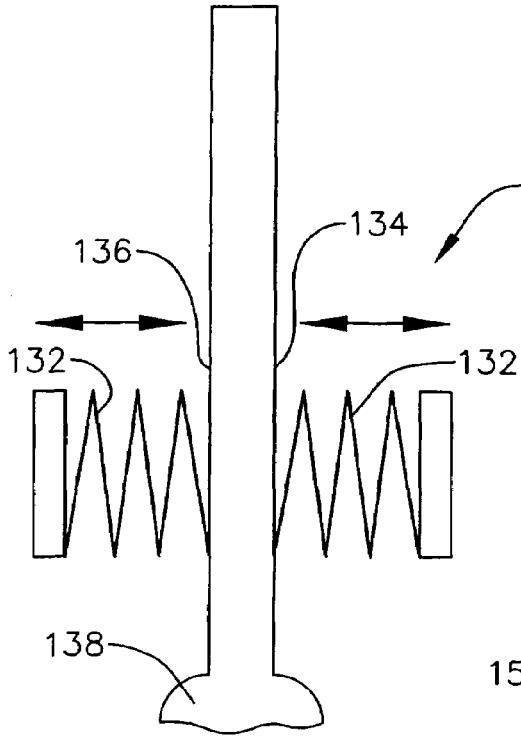
FIG. 9 is a side view showing one exemplary embodiment of a mechanical separation displacement mechanism of the invention.

FIG. 9 is a side view showing an exemplary embodiment of a mechanical separation mechanism 130 of the invention. The exemplary mechanical separation mechanism 130 can comprise arms 132 which extend from at least one side, and preferably both sides 134 and 136 of the hanger 138, for example, in the region of the hanger just below where the hook portion hangs on the rod. The arms 132 can comprise, for example, springs which provide a lateral pushing force that will act upon an adjacent arms 132 of adjacent hangers if the hanger is too close, and thereby cause the other hangers to move to establish more equal spacing between hangers on a rod. Although springs are shown, resilient material, such as elastomeric sponge material, air cushions, plastic arms, or other structures and designs can be utilized.

Figure 10:
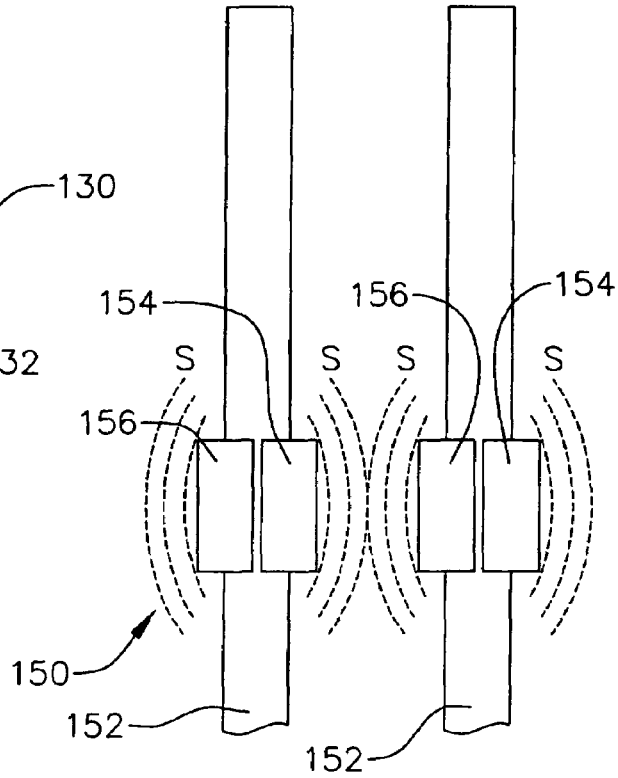
FIG. 10 is a side view showing one exemplary embodiment of a magnetic separation displacement mechanism of the invention.

FIG. 10 is a side view showing an exemplary embodiment of a magnetic separation mechanism 150 of the invention, fitted onto two adjacent hangers 152 of the invention. The magnetic separation mechanism 150 can comprise pairs of permanent magnets 154 and 156 aligned with their like polarities facing each other (e.g. the north or south sides facing each other) so that a South (or North) magnetic field is set up at both sides of the hanger, which will repulse other hangers with a like magnetic separation mechanism 150. One advantage of using pairs of magnets adjacent to each other with like polarities facing each other is that no matter which direction a hanger is placed on a rod, a repulsive magnetic force will be established.

Of course, it is also possible to use single permanent magnets in each hanger, and have sets of hangers that would pair of hangers with N-S polarity alignment and S-N alignment. In this arrangement, hangers would have to be placed in a closet with the two different types of hangers arranged for magnetic repulsion, such as N-S, S-N, N-S, and S-N. This is clearly less desirable than pairs of magnets since more attention would need to be taken when hangers are placed on a rod, since if two hangers have the same polarity alignment (e.g. N-S and N-S) where to be placed adjacent to each other on a rod, the hangers would tend to be drawn together. As shown in FIG. 2, one or more of the permanent magnets can be used in the hanger of the invention, depending on how much repulsive force is desired.

Figure 11A:
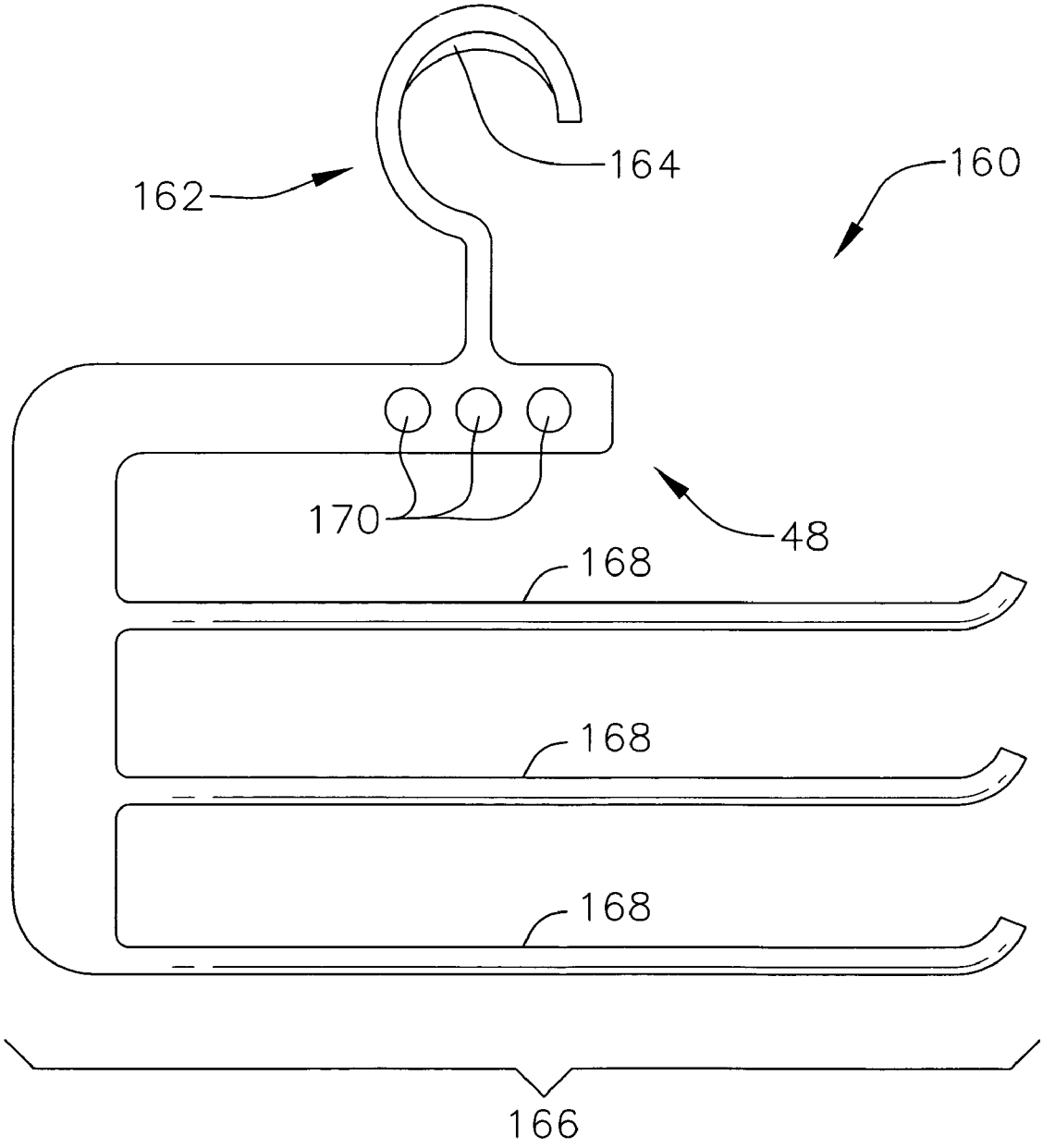
FIG. 11A is a side view of an exemplary embodiment of a hanger of the invention for holding multiple items.

While FIG. 2 depicts a fairly conventional, generally triangular-shaped lower hanger portion 42, other lower hanger shapes and embodiments can be used, e.g., hangers with multiple horizontal arms, hangers for carrying belts and ties, For example, FIG. 11A is a side view of another exemplary embodiment of a hanger 160, e.g. for holding multiple items (e.g., slacks—not shown) with a hook 162 with friction reducing material 164 located on a underside thereof. The hook 162 is connected to a lower, wider body portion 166 having multiple horizontal arms 168. Magnets 170 can be located below the hook 162.

Figure 11B:
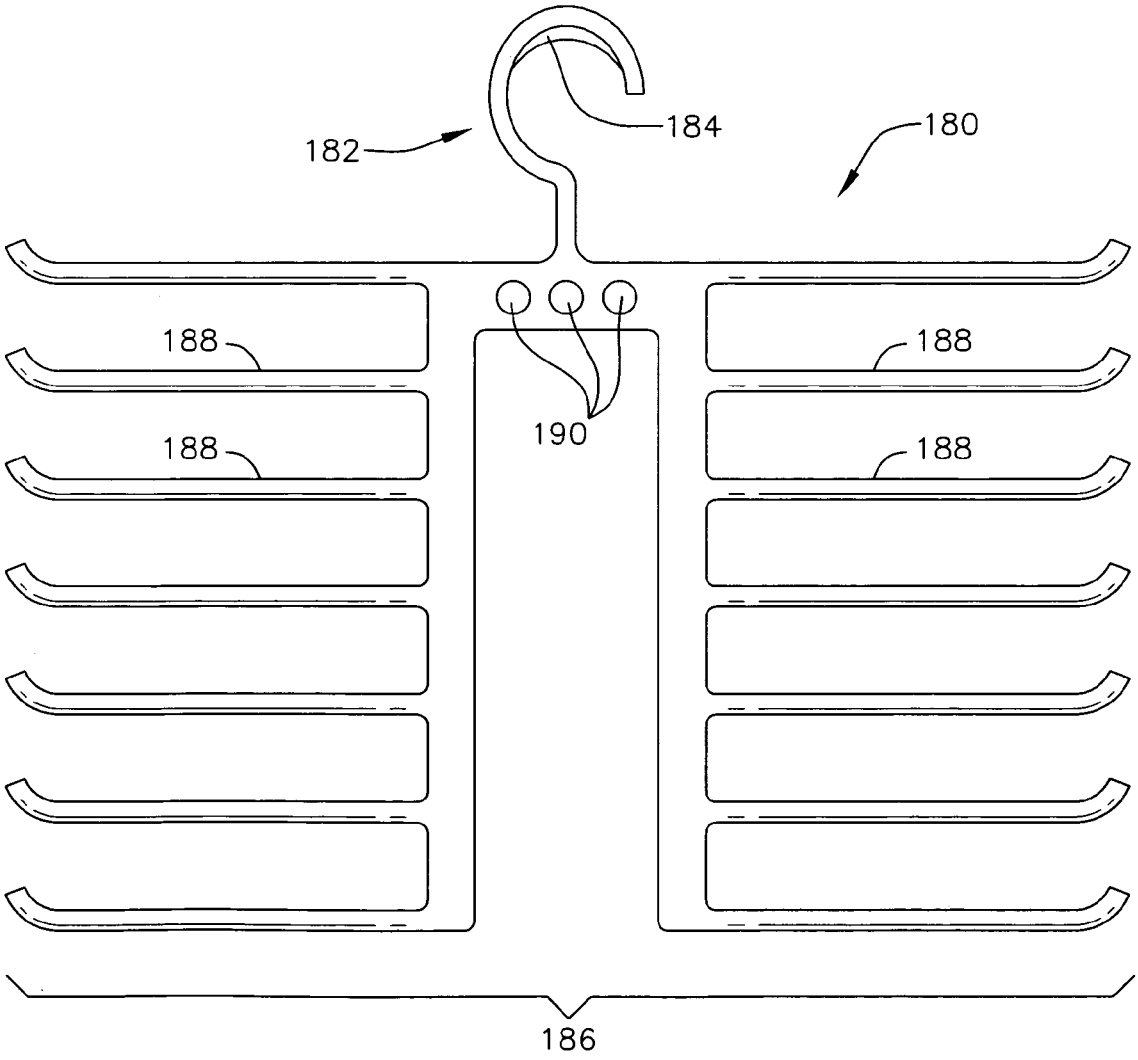
FIG. 11B is a side view of another exemplary embodiment of a hanger for holding multiple items.

FIG. 11B is a side view of yet another exemplary hanger 180, e.g., for holding multiple items (e.g., ties—not shown) having a hook 182 with friction reducing material 184 located on an underside thereof. The hook 182 is connected to a lower, wider body portion 186 having multiple horizontal arms 188. Magnets 190 can be located below the hook 182. With reference to FIGS. 11A and 11B, other friction reducing elements (e.g., ball bearings, rollers, etc.) can be used, and other lateral displacement devices (mechanical activated) can be used.

As used with reference to the various embodiments herein, the term "hanger" refers to hangers that have a neck portion that ride on a rod or rack and have a lower, wider body portion or body portions that can support any number of items, including but not limited to items such as clothing and accessories, e.g., pants, shirts, jackets, suits, belts, ties, etc.

Having thus described exemplary embodiments of the present invention, it should be understood by those skilled in the art that the above disclosures are exemplary only and that various other alternatives, adaptations and modifications may be made within the scope of the present invention. The presently disclosed embodiments are to be considered in all respects as illustrative and not restrictive.

What is claimed is:

1. A low friction clothes hanger system for reducing the lateral force required to move a clothes hanger on a supporting clothes hanger rod having an outer surface with an uppermost edge surface, comprising:

a hanger hook;

a friction reducing element located between the clothes hanger hook of a clothes hanger and a supporting rod, the friction reducing element comprising, a roller on the clothes hanger hook which roller has a preformed concave rolling surface with an apex, which apex rolls generally on the uppermost edge surface of the supporting clothes hanger rod, or a plurality of rollers with rolling surfaces which contact and roll on the supporting clothes hanger rod; and a lower hanger balance beam body portion, connected to the clothes hanger hook, that is laterally wider than a width of the clothes hanger hook.

2. The low friction clothes hanger system of claim 1, wherein the plurality of rollers comprise a plurality of spaced apart ball bearings.

3. The low friction clothes hanger system of claim 1, wherein the friction reducing element is integral with the clothes hanger hook.

4. The low friction clothes hanger system of claim 1, wherein the friction reducing element is attachable to a hanger hook without a friction reducing element.

5. The low friction clothes hanger system of claim 1, wherein the hanger further comprises a lateral displacement device that aids in the lateral displacement of the clothes hanger relative to other clothes hangers.

6. The low friction clothes hanger system of claim 5, wherein the lateral displacement device comprises magnets.

7. The low friction clothes hanger system of claim 5, wherein the lateral displacement device comprises a mechanical device that extends laterally from the clothes hanger.

8. A low friction clothes hanger system for reducing the lateral force required to move a clothes hanger on a supporting rod having an outer surface with an uppermost edge surface, comprising:

a clothes hanger hook having a width;

a lower hanger balance beam body portion that is connected to the clothes hanger hook and is laterally wider than the clothes hanger hook;

a friction reducing element located on the hanger hook, the friction reducing element comprising, a roller on the clothes hanger hook which roller has a preformed concave rolling surface with an apex, which apex rolls generally on the uppermost edge surface of the supporting clothes hanger rod, or a plurality of rollers with rolling surfaces which contact and roll on the supporting clothes hanger rod; and a lateral displace device to aid in the lateral displacement of one clothes hanger relative to another adjacent clothes hanger.

9. The low friction clothes hanger system of claim 8, wherein the lateral displacement device comprises magnets.

10. The low friction clothes hanger system of claim 8, wherein the lateral displacement device comprises spring arms that extends laterally from the clothes hanger.

11. A method for aiding the alignment of items that are hung on clothes hangers on a supporting clothes hanger rod of claim 1, comprising:

hanging an item on the clothes hanger; and placing the clothes hanger in contact with the supporting clothes hanger rod then letting go of the clothes hanger, allowing the weight of the item on the clothes hanger to fall to a point of equilibrium.

12. The method of claim 11, wherein pushing or brushing two or more clothes hangers facilitates the natural tendency for the low friction clothes hangers to space themselves apart from one another.

* * * * *